United States Patent [19]

Carlson

[11] 3,934,341

[45] Jan. 27, 1976

[54] CARPET CUTTING TOOL

[76] Inventor: Larry A. Carlson, 64 Cheyenne Drive, Nashua, N.H. 03060

[22] Filed: Oct. 9, 1974

[21] Appl. No.: 513,317

[52] U.S. Cl. ..... 30/287; 30/293; 30/294

[51] Int. Cl.[2] ..... B26B 29/00

[58] Field of Search ..... 30/293, 287, 294, 289

[56] References Cited

UNITED STATES PATENTS

| | | | |
|---|---|---|---|
| 2,601,183 | 6/1952 | Unsinger | 30/293 |
| 3,337,955 | 8/1967 | Poletajev | 30/294 |
| 3,535,786 | 10/1970 | Sanders | 30/293 |
| 3,543,401 | 12/1970 | Scott et al | 30/294 |
| 3,737,932 | 6/1973 | Armijo | 30/293 |

FOREIGN PATENTS OR APPLICATIONS

| | | | |
|---|---|---|---|
| 68,020 | 9/1929 | Sweden | 30/293 |
| 162,414 | 2/1949 | Austria | 30/294 |
| 171,473 | 6/1906 | Germany | 30/293 |

*Primary Examiner*—James L. Jones, Jr.
*Assistant Examiner*—J. T. Zatarga
*Attorney, Agent, or Firm*—Morse, Altman, Oates & Bello

[57] ABSTRACT

A tool is provided for use primarily by professional carpet installers to trim an even strip of carpet around the boundary of a pad or pre-laid carpet prior to the installation of new wall-to-wall carpeting. The tool includes a body portion having an angularly adjustable handle and carrying a pair of cutters mounted to the front wall thereof and projecting downwardly to cut a rug or a pad when the body portion is moved over the top surface of a carpet or pad. The body portion is mounted on rollers and is also provided with an adjustable guide which slides against the wall or baseboard to control the width of the cut being made.

1 Claim, 4 Drawing Figures

CARPET CUTTING TOOL

BACKGROUND OF THE INVENTION

1. Field of the Invention

This invention relates generally to hand tools and more particularly is directed towards a tool for cutting carpets, pads and the like in a straight, even strip around the border thereof.

2. Description of the Prior Art

Professional carpet installers frequently are called upon to install wall-to-wall carpeting over a previously installed older carpet which may have been cemented to the floor as is often done to rubber-back carpets. Such cemented carpets are extremely difficult to remove completely and it is, therefore, a common practice to leave the older carpet in place and use it as a pad for a new carpet installed directly over the old carpet. When carrying out this type of installation, it is necessary to cut away a border strip around the edge of the old carpet in order to allow room to install wooden tack strips along the baseboard. Such tack strips usually are on the order of an inch or so in width and are nailed or otherwise attached directly to the floor and are provided with a plurality of tacks or barbs along their upper surfaces to grip the edge of the new carpet and hold it tightly in place. Prior to installing the wooden tack strip, the border of the old carpet is cut back about 2 in. all around the old carpet. Heretofore, this cutting operation has been done with a common utility knife. In practice, it is extremely difficult for a person to make a straight cut, particularly over a long stretch, and carpet installers may have to make two or more passes around the room before a reasonably straight cut of a proper width is made. Even then the cut may be irregular with the result that the overlaying carpet may not be fully supported throughout and may show a certain amount of unevenness around the edge.

Accordingly, it is an object of the present invention to provide a new and improved carpet-cutting tool adapted to make a straight line cut of a carpet, pad or the like, in a strip of uniform width in one pass. Another object of this invention is to provide a carpet-cutting tool which is adjustable to make cuts of different widths and depths in accordance with the type of carpeting installed and the width of the tack strip to be laid.

SUMMARY OF THE INVENTION

This invention features a carpet-cutting tool comprising a body portion, an angularly adjustable handle mounted to the top of the body portion, rollers mounted to the underside of the body portion to provide smooth rolling contact with the underlying floor or carpet, a guide adjustably attached to the body portion and extending in spaced relation to the forward edge of the body portion to engage the baseboard and provide a pre-set distance between the body portion and the baseboard, and a pair of cutting elements mounted to the forward edge of the body portion and extending downwardly for cutting engagement with the carpet. The body portion and gauge are provided with graduated markings for measuring the width of the cut to be made.

DETAILED DESCRIPTION OF THE PREFERRED EMBODIMENT

Figure 1:
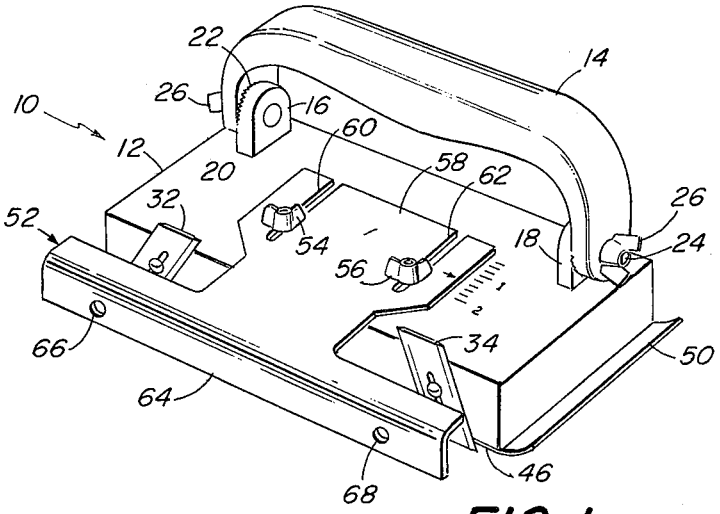
FIG. 1 is a view in perspective of a carpet-cutting tool made according to the invention.

Referring now to the drawings, the reference character 10 generally indicates a tool for use primarily by carpet installation personnel in cutting away an even strip of pad or carpeting about the border of a rug adjacent the baseboard for installation of a tack strip. The tool 10 is generally organized about a body portion 12 which, in the preferred embodiment, is a rectangular block typically seven inches in length and three inches in width. The thickness may be on the order of perhaps an inch or so and, in any event, these dimensions are only by way of example and obviously may be modified. In practice, the body 12 may be fabricated from a block of wood, metal, such as steel or aluminum, or plastic, for example, and may be solid or hollow.

The tool is provided with a handle 14 which, in the preferred embodiment, is angularly adjustable being mounted to the top wall of the block 12 by means of a pair of spaced bosses 16 and 18 each having a circular array of gear teeth 20 for locking engagement with a cooperating circular set of gear teeth 22 formed on the inner opposing end faces of the C-shaped handle 14. The ends of the handle 14 as well as the bosses 16 are formed with openings to receive a threaded bolt 24 to which is connected a wing nut 26 by which the angular position of the handles 14 with respect to the block 12 may be adjusted through a range of approximately 180°. It will be understood that the angular position of the handle may be readily changed by backing off of the wing nuts 26 sufficiently to disengage the gear teeth 20 and 22 and selecting an angle best suited to the worker. Once the angle has been set, the wing nuts 26 are tightened and the handle is again clamped tightly in a locked position.

Formed diagonally in the front face of the block 12 is a pair of shallow grooves 28 and 30 in each of which is seated a cutter 32, 34. The cutters 32 and 34 should be thin and as sharp as possible along their cutting edges which extend along the long edges of the cutters. The cutters are held in position by means of set screws 36 and 38 threaded into tapped holes formed centrally in the grooves 28 and 30. In practice, the cutters 32 and 34 are of a trapezoidal outline with the lower edges being substantially parallel with the floor. Both long edges are sharp to permit the tool to be worked back and forth to provide cutting action in both directions. The cutters preferably are formed with central slots 40 through which the shanks of the mounting screws 36 and 38 pass and which allow the cutters to be adjusted according to the depth of the cut being made. The cutters are thin and mounted flat against the forward face of the block 12 and are co-planar with one another. In practice, the tool is used by moving the same in a direction parallel to the baseboard and also parallel to the plane of the cutters.

To provide a smooth, easy motion of the tool, the block 12 is provided with rollers 42, typically four in number and mounted to the bottom of the block in pairs extending slightly below the bottom of the block. To further facilitate the motion of the tool, particularly when used on plush or other thick carpets, a smooth, flat plate 46 is provided across the bottom of the tool with the opposing ends of the plate being curved upwardly in smoothly, rounded bends 48 and 50 which allow the tool to ride smoothly over the nap of a thick pile without any sharp corners or edges which might interfere with such motion.

Figure 3:
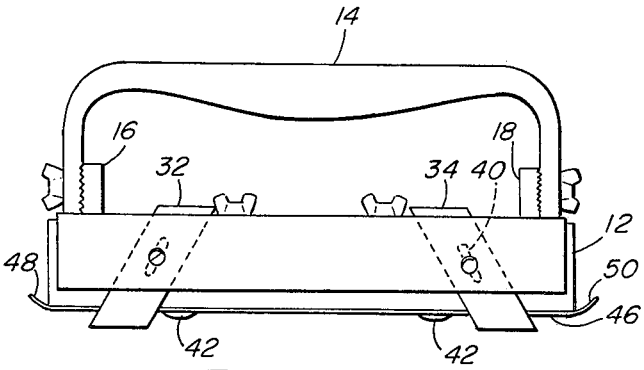
FIG. 3 is a view in front elevation thereof, and, FIG. 4 is a view in side elevation showing the tool in a typical cutting position.
Figure 4:
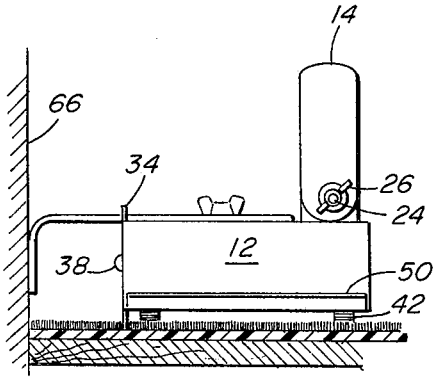

In order to insure that the cut made by the tool is parallel to the baseboard and the cut strip is of the same width all about the room, an adjustable wall guide 52 is provided. The guide 52, in the illustrated embodiment, is a rigid one-piece part typically formed of sheet metal and adjustably connected to the block 12 by means of a pair of wing nuts 54 and 56 threaded to a pair of cooperating threaded studs extending in spaced relation upwardly from the top face of the block 12. The guide 52 is somewhat T-shaped having a flat center leg portion 58 which is held flat against the top face of the block 12 by means of the wing nuts 54 and 56. The leg 58 is formed with a pair of parallel, re-entrant slots 60 and 62 to receive the threaded studs to which the wing nuts are connected. The guide 52 is also formed with an extension 64 projecting perpendicularly from the leg 58 but parallel to the plane of the cutters 32 and 34 in the forward face of the block 12. The extension 64 is integral with the leg portion 58 but is bent downwardly at a right angle to the plane of the leg portion 58 so that its outer face will bear flat against a baseboard 66 as suggested in FIG. 4. Preferably, the extension 64 has a length generally corresponding with the full length of the block to enhance stabilization of the tool when pressed against the baseboard. The extension also is smoothly rounded at the bend where it depends from the horizontal flat portion 58 so as to minimize the possibility of scratching or scoring the baseboard 66. The extension has its lower edge slightly raised above the plane of the bottom of the block as shown in FIG. 3 so as to be clear of the carpet and thereby prevent the tool from snagging or dragging on the carpet. Also, the extension is formed with a pair of spaced openings 66 and 68 which register with the screws 36 and 38 which hold the cutters. In this manner, a screwdriver may be inserted through the openings 66 and 68 to tighten or loosen the screws 36 and 38 for adjustment or replacement of the cutters 32 and 34 without removing the guide 52.

The guide 52 may be adjusted with respect to the block 12 by loosening the wing nuts and moving the guide inwardly or outwardly depending upon the width of the cut to be made. It will be understood that the position of the guide with respect to the block will determine the width of the cut as may be seen in FIG. 4 and this cut will continue along evenly from the baseboard 66 and will be true and straight throughout the room. By moving the guide in or out, a narrower or wider strip of carpet may be cut away as required. The workman merely places the tool on the carpet with the outer face of the guide extension bearing against the baseboard and then pushes it down. He then works the tool along the baseboard with the cutters extending into the carpet and cutting the carpet as the tool is moved along. Since a pressure downwardly and inwardly is required to hold the guide against the wall and also to cut into the carpet, the handle 14 may be set at an angle best suited for this purpose.

Figure 2:
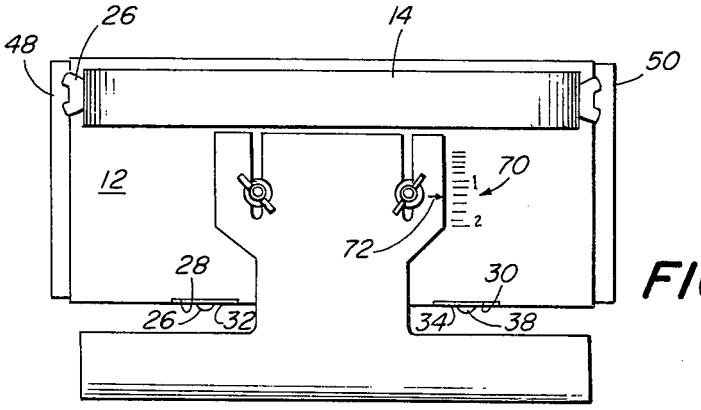
FIG. 2 is a top plan view thereof.

In order to allow the tool to be pre-set according to the width of the cut to be made without separately measuring or marking the carpet, a scale 70, typically covering a two inch range, is applied to the top face of the block 12 closely adjacent a side edge of the plate 58 as best shown in FIGS. 1 and 2. The plate 58, in turn, is provided with a reference mark 72 directly opposite the scale 70 so that the worker may be able to quickly adjust the guide to whatever width of cut that is to be made.

Having thus described the invention what I claim and desire to obtain by Letters Patent of the United States is:

1. A tool for cutting installed carpets and the like along a line parallel to a baseboard or the like, comprising a. a body portion having a substantially flat horizontal upper face and a substantially flat vertical front face, b. a handle connected to the upper face of said body portion and being angularly adjustable with respect to said body portion about an axis parallel to said front face, c. a pair of screw -mounted thin, flat cutting blades detachably mounted flat against the front face of said body portion in a substantially vertical plane and each having a cutting edge thereof extending downwardly from the body portion in diagonally different directions for cutting engagement with said carpet, a smooth flat plate formed with upwardly curved ends mounted to the bottom of said body portion, e. a plurality of rollers mounted in spaced relation along the bottom of said body portion for rotation about parallel horizontal axes perpendicular to said front face, f. adjustable guide means extending from said body portion in spaced parallel relation to said cutting blades for sliding engagement with said baseboard, g. said guide means including a horizontally disposed flat leg portion adjustably connected to the upper face of said body portion and extending therefrom perpendicular to said front face, h. said guide means also including a verically disposed straight, smooth, flat wall at the free end of the said leg portion and perpendicular thereto for sliding engagement with said baseboard, said wall being substantially co-extensive with and parallel to said front face and formed with an opening in registration with each cutting element, i. cooperating measuring indicia on the leg portion of said guide means and on the upper face of said body portion for measuring the spacing between the wall of said guide means and said cutting blades.

* * * * *